US007460814B2

(12) United States Patent
Ito

(10) Patent No.: US 7,460,814 B2
(45) Date of Patent: Dec. 2, 2008

(54) IMAGE DEVICE HAVING AN OPENING/CLOSING COVER

(75) Inventor: Hiroshi Ito, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 250 days.

(21) Appl. No.: 11/258,222

(22) Filed: Oct. 26, 2005

(65) Prior Publication Data

US 2007/0091157 A1 Apr. 26, 2007

(51) Int. Cl.
*G03G 21/00* (2006.01)

(52) U.S. Cl. ..... 399/124; 347/104

(58) Field of Classification Search ..... 399/21, 399/124

See application file for complete search history.

(56) References Cited

U.S. PATENT DOCUMENTS

2005/0036804 A1* 2/2005 Yokoi ..... 399/124
2005/0163533 A1* 7/2005 Hashimoto et al. ..... 399/124
2006/0018672 A1* 1/2006 Asaba ..... 399/124

* cited by examiner

*Primary Examiner*—David M Gray
*Assistant Examiner*—Ruth N Labombard
(74) *Attorney, Agent, or Firm*—Global IP Counselors, LLP

(57) ABSTRACT

To handle a paper jam, an opening/closing cover 21 is swiveled a predetermined angle around a pivoting shaft 16*a*, with the opening/closing cover 21 and a paper transport guide member 22*a* in an unlocked state, to open the opening/closing cover 21. The paper transport guide member 22*a* opens thereupon by swiveling around a pivoting shaft 16*b* in response to the opening movement of the opening/closing cover 21, thereby opening simultaneously a paper transport path 10 and a reverse transport path 15.

9 Claims, 7 Drawing Sheets

IMAGE DEVICE HAVING AN OPENING/CLOSING COVER

FIELD OF THE INVENTION

The present invention relates to an image forming device such as a copying machine, a fax device, a printer or the like, and to an image forming device comprising a duplex unit (reverse transport unit).

BACKGROUND INFORMATION

Image forming devices where images are formed on both faces of a paper sheet generally comprise a so-called duplex unit (reverse transport unit) having a function whereby a paper sheet having an image formed on one face thereof is received, reversed, and transported again to a transfer unit.

A constitution with such a reverse transport unit makes the device as a whole extremely compact, which allows for saving space; however, this constitution is problematic in that the paper transport path has herein a complex configuration, which increases the incidence rate of paper jams and, once a paper jam occurs, makes it difficult to remove the paper sheets.

Various image forming devices have thus been disclosed with a view of improving workability of paper removal when a jam occurs. In such image forming devices, to remove jammed paper sheets from a paper transport path disposed in a paper transport unit, the reverse transport unit is swung, and then the paper transport path of the paper transport unit is opened by opening an opening/closing cover of the device main body. For removing paper sheets upon occurrence of a jam in a paper transport path disposed in the reverse transport unit (hereinafter referred to as "reverse transport path"), first the reverse transport unit is swung away from the image forming device main body, and then an inner frame member provided inside the reverse transport unit is swung to open the reverse transport path.

The above conventional image forming devices, however, are problematic in that it is necessary to separately operate the reverse transport unit and the opening/closing cover (or the internal frame member) for removing jammed paper sheets, which is troublesome as it complicates manipulations during jam removal. When in particular a paper jam occurs inside the reverse transport path, the opening angle of the reverse transport path cannot be made large unless the internal frame is swung counterclockwise far away from the reverse transport unit which has been swung clockwise, requiring highly bothersome manipulations in order to secure sufficient space for handling the paper jam.

With a view of solving the above problems, it is an object of the present invention to provide an image forming device comprising a paper transport path and a reverse transport path wherein jammed paper sheets can be easily removed from each transport path.

SUMMARY OF THE INVENTION

In order to achieve the above goal, the present invention is an image forming device comprising: a device main body; an image forming unit for forming images on paper; a paper feeding unit disposed upstream from the image forming unit, for transporting the paper to the image forming unit; an output unit disposed downstream from the image forming unit, for storing output paper upon which images have been formed by the image forming unit; a paper transport path disposed between the paper feeding unit and the output unit; a reverse paper transport path extending along a side face of the device main body, for reversing the paper having an image formed on one face thereof, and for transporting the paper to the image forming unit; an opening/closing member pivotally supported relative to the device main body; and a pivotably supported paper transport guide member constituting the paper transport path and the reverse transport path and moving in response to an opening/closing movement of the opening/closing member, the paper transport guide member swiveling in response to the opening movement of the opening/closing member thereby opening simultaneously the paper transport path and the reverse transport path.

In the image forming device according to the present invention, the opening/closing member and the paper transport guide member may be supported by different pivoting shafts.

In the image forming device according to the present invention, also, the opening/closing member may be provided with a support member for supporting the paper transport guide member during swiveling of the paper transport guide member.

In the image forming device according to the present invention, also, the paper transport guide member may be provided with a protrusion that slides while abutting the support member during swiveling of the paper transport guide member.

The image forming device according to the present invention may also comprise a first locking member for locking the opening/closing member to the device main body; a second locking member for locking the paper transport guide member to the device main body; and an unlocking member for unlocking the opening/closing member and the paper transport guide member; wherein the first and second locking members move in response to an operation of the unlocking member thereby simultaneously unlocking the opening/closing member and the paper transport guide member.

Herein, the first and second locking members may be pivotally supported, the image forming device according to the present invention further comprising a shifting member movably provided between the first locking member and the second locking member such that, in response to an operation of the unlocking member, the first locking member swings in the unlocking direction thereby unlocking the opening/closing member, the shifting member shifts pushed by the first locking member, and the second locking member swings in the unlocking direction in response to the shift of the shifting member, thereby unlocking the paper transport guide member.

Further, the image forming device of the present invention may be a tandem-type color image forming device.

In the present invention, the paper transport path and the reverse transport path are simultaneously opened through swiveling of the paper transport guide member in response to the opening movement of the opening/closing member; upon handling a paper jam, therefore, the paper transport path and the reverse transport path can thus be simultaneously opened by opening the opening/closing member alone. It is not necessary therefore to separately operate the opening/closing member and the paper transport guide member, which improves operability during removal of jammed paper.

In the present invention, also, the opening/closing member and the paper transport member are supported by different rotating shafts, which affords a large opening angle of the paper transport path and the reverse transport path, allowing the jammed paper to be easily removed.

In the present invention, also, the opening/closing member is provided with a support member for supporting the paper transport guide member during swiveling of the paper transport guide member. The reverse transport path, therefore, does not close on account of the weight of the paper transport guide member itself upon simultaneous opening of the paper transport path and of the reverse transport path, so that the reverse transport path can thus remain open, allowing the jammed paper to be easily removed.

In the present invention, the paper transport guide member is also provided with a protrusion for sliding while abutting the support member upon swiveling of the paper transport guide member. The paper transport guide member can therefore swivel further out around a pivoting shaft while supported on the opening/closing member, which enables a smooth swiveling of the paper transport guide member.

In the present invention, also, the opening/closing member and the paper transport guide member can be simultaneously unlocked by a shift in an unlocking direction of a first and second locking members in response to the operation of an unlocking member. It thus becomes possible to open simultaneously both first and second locking members by operating only the unlocking member, which facilitates unlocking when handling a paper jam.

In the present invention, furthermore, the first and second locking members are pivotally supported, the image forming device according to the present invention further comprising a shifting member movably provided between the first locking member and the second locking member such that, in response to an operation of the unlocking member, the first locking member swivels in the unlocking direction thereby unlocking the opening/closing member, the shifting member shifts pushed by the first locking member, and the second locking member swivels in the unlocking direction in response to the shift of the shifting member, thereby unlocking the paper transport guide member. The first and second locking members can therefore be simultaneously opened using a simple constitution.

DETAILED DESCRIPTION OF THE PREFERRED EMBODIMENTS

Figure 1:
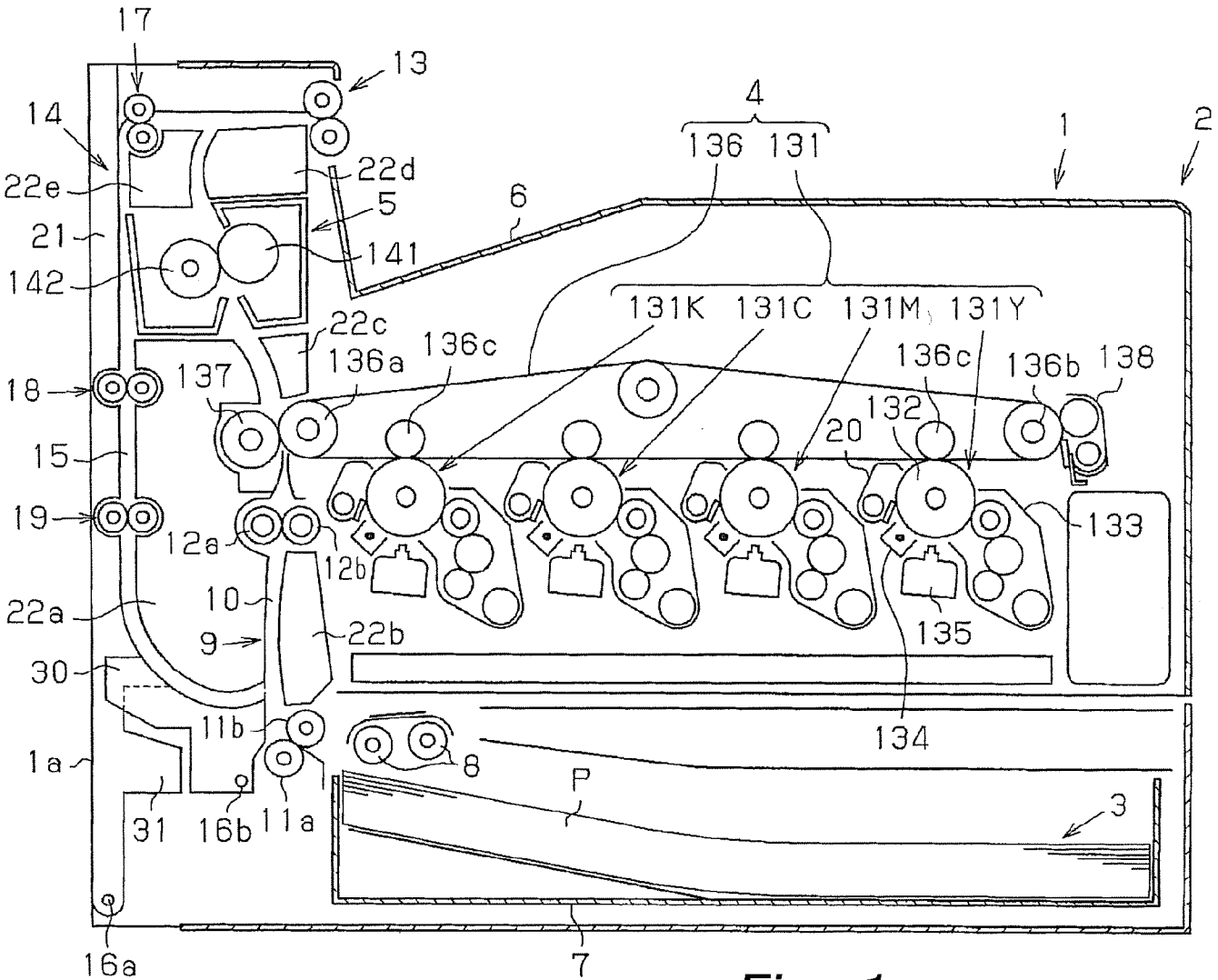
FIG. 1 is a schematic view illustrating the overall constitution of an image forming device according to an embodiment of the present invention.

Specific embodiments of the present invention are described below with reference to the accompanying drawings. FIG. 1 is a schematic view illustrating the overall constitution of an image forming device according to an embodiment of the present invention.

As shown in FIG. 1, an image forming device 1, a so-called vertical transport-type image forming device, comprises a box-shaped device main body 2, a paper feeding unit 3 disposed in the lower portion of the device main body 2, an image forming unit 4 disposed in the upper portion of the paper feeding unit 3, a fixing unit 5 disposed in the upper left portion of the image forming unit 4, and an output unit 6 disposed in the upper portion of the device main body 2.

The paper feeding unit 3 comprises a paper feeding cassette 7 where paper P is stored; the paper P is transported from the paper feeding cassette 7 towards a paper transport unit 9 through the rotation of paper feeding rollers 8 and via a pair of separation rollers 11*a*, 11*b* for preventing multiple feeding of the fed paper P. The paper P is thus transported towards the image forming unit 4 along a paper transport path 10 disposed between the paper feeding unit 3 and the output unit 6, via a pair of resist rollers 12*a*, 12*b*. The paper feeding cassette 7 is constituted so as to be removably attached to the device main body 2.

The image forming unit 4, in which predetermined toner images are formed on the paper P by an electrophotographic process, comprises an image transfer unit 131, a transfer belt 136 onto the surface whereof the toner images are transferred by the image transfer unit 131, and a secondary transfer roller 137 for further transferring the toner image on the transfer belt 136 onto the paper P conveyed from the paper feeding cassette 7. The secondary transfer roller 137 is provided at a position immediately to the left of the image transfer unit 131.

The image forming device 1 of the present embodiment is a so-called tandem-type color image forming device, in which the image transfer unit 131 comprises, in the order of upstream (the right side in FIG. 1) to downstream, a yellow unit 131Y, a magenta unit 131M, a cyan unit 131C, and a black unit 131K. These units 131Y, 131M, 131C, 131K are installed and positioned maintaining a predetermined relative positional relationship with various devices inside the device main body 2.

Each unit 131Y, 131M, 131C, 131K comprises a photosensitive drum 132, as an example of an image carrier, rotatably supported at a central position of each unit, and rotating in a predetermined direction (counterclockwise direction), and a developing device 133 provided on the right side of each photosensitive drum 132 in FIG. 1. Toner is supplied from the developing device 133 to the peripheral face of the photosensitive drum 132 rotating counterclockwise around a central axis, to form thereby a toner image on the peripheral face of the photosensitive drum 132.

At the upper left position in FIG. 1 of each photosensitive drum 132 is provided a cleaning device 20 for cleaning the peripheral face of the photosensitive drum 132 by removing residual toner therefrom; and at a position lower than the cleaning device 20 is provided a charger 134. The peripheral face of the photosensitive drum 132, which has been cleaned by the cleaning device 20, lies opposite the charger 134 for renewed electrostatic charging.

An exposure device 135 is provided at a position immediately below the photosensitive drum 132. On the basis of image data input via an image reading device, which is not shown in the figures, this exposure device 135 irradiates laser light to the peripheral face of the photosensitive drum 132, which has been uniformly charged by the charger 134, so as to form an electrostatic latent image on the peripheral face of the photosensitive drum 132. Toner from a toner container in the developing device 133 is supplied to that electrostatic latent image to form a toner image on the peripheral face of the photosensitive drum 132; this toner image is then transferred by the transfer belt 136 onto the paper P being transported.

The transfer belt 136, positioned immediately above the units 131Y, 131M, 131C, 131K is stretched tightly between a driving roller 136*a* and a driven roller 136*b*, the surface side of the transfer belt 136 abutting the peripheral side of the photosensitive drums 132. Immediately over each photosensitive drum 132 is provided a primary transfer roller 136*c*, the transfer belt 136 being disposed between the primary transfer roller 136*c* and the photosensitive drums 132; these primary transfer rollers 136*c* push the transfer belt 136 so as to prevent the latter from losing contact with the photosensitive drums 132.

Through the revolving of the transfer belt 136, driven by the driving roller 136*a*, and with a predetermined timing timed with the revolving transfer belt 136, the toner images formed on each photosensitive drum 132 are transferred by the primary transfer rollers 136*c* to the surface of the transfer belt 136 that is revolving clockwise, in an overpainted fashion. Next, the color image formed on the surface of the transfer belt 136 is transferred to the paper P being transported from the paper feeding unit 3 which is disposed upstream from the image forming unit 4 (downward in FIG. 1) between the secondary transfer roller 137 and the driving roller 136*a*, so as to a color transfer image on the paper P.

A transfer belt cleaning device 138 is further provided to the right of the driven roller 136*b* for removing from the surface of the transfer belt 136 residual toner remaining after the toner image has been transferred onto the paper P. A clean transfer belt 136 is thus fed to the photosensitive drum 132.

The transfer image transferred onto the paper P in the image forming unit 4 is subjected to an image fixing treatment in the fixing unit 5, which comprises a heating roller 141 heated by an electroconductive heating member, and a pressure roller 142 disposed opposite the heating roller 141, such that the peripheral face of the pressure roller 142 abuts the peripheral face of the heating roller 141 exerting pressure thereon. The transfer image transferred onto the paper P by the secondary transfer roller 137 in the image forming unit 4 is fixed through a fixing treatment in which the paper P is heated by passing between the heating roller 141 and the pressure roller 142. The paper P is then output by way of a pair of output rollers 13 to an output unit 6 disposed downstream (upwards in FIG. 1) from the image forming unit 4, so that the paper P is stored in the output unit 6.

In the image forming device 1 of the present embodiment, there is also provided a reverse transport unit 14, disposed on a side 1*a* of the device main body 2, as illustrated in FIG. 1. A reverse transport path 15 extends in the reverse transport unit 14 along the side 1*a*; this reverse transport path 15 is disposed closer to the side 1*a* than the paper transport path 10. In this reverse transport path 15 the paper P having an image formed on one face thereof is reversed and is transported to the image forming unit 4; herein, the two ends of the reverse transport path 15 are formed so as to communicate with the upstream and downstream of the paper transport path 10.

During reverse-transport of the paper P, the paper P having an image fixed on one face thereof is output to a predetermined length by the output roller pair 13, whereupon the output roller pair 13 is reverse-driven to switch back the paper P and transport the latter toward the reverse transport path 15, whereby the front and back faces of the paper P are reversed and the paper P is transported to the image forming unit 4 again. Branching means may be provided at the junction positions of the reverse transport path 15 and the paper transport path 10 so that, by controlling the operation of the branching means through the switching on/off of a driving mechanism such as a solenoid or the like, the paper P may be transported toward the reverse transport path 15.

The reversed paper P is guided to the reverse transport path 15 and is transported again to the upstream region of the paper transport path 10 via the transport roller pairs 17 through 19. The paper P is then transported along the paper transport path 10 towards the image forming unit 4, which forms an image on the other face of the paper P; the transfer image is then fixed in the fixing unit 5, after which the paper P is output to the output unit 6 via the output roller pair 13.

On one side (the left side in the present embodiment) of the device main body 2 of the image forming device 1 of the present embodiment is further provided an opening-closing cover 21 pivotably supported by a pivoting shaft 16*a*.

As illustrated in FIG. 1, a plurality of paper transport guide members 22*a* through 22*e* are provided inside the opening/closing cover 21, which is an opening/closing member, and the device main body 2, for guiding the paper P as it is transported along the paper transport path 10 and the reverse transport path 15. Among these, the paper transport guide member 22*a*, which constitutes the paper transport path 10 and the reverse transport path 15, is pivotably supported by a pivoting shaft 16*b* provided at a different position than that of the pivoting shaft 16*a* supporting the opening/closing cover 21.

Figure 2:
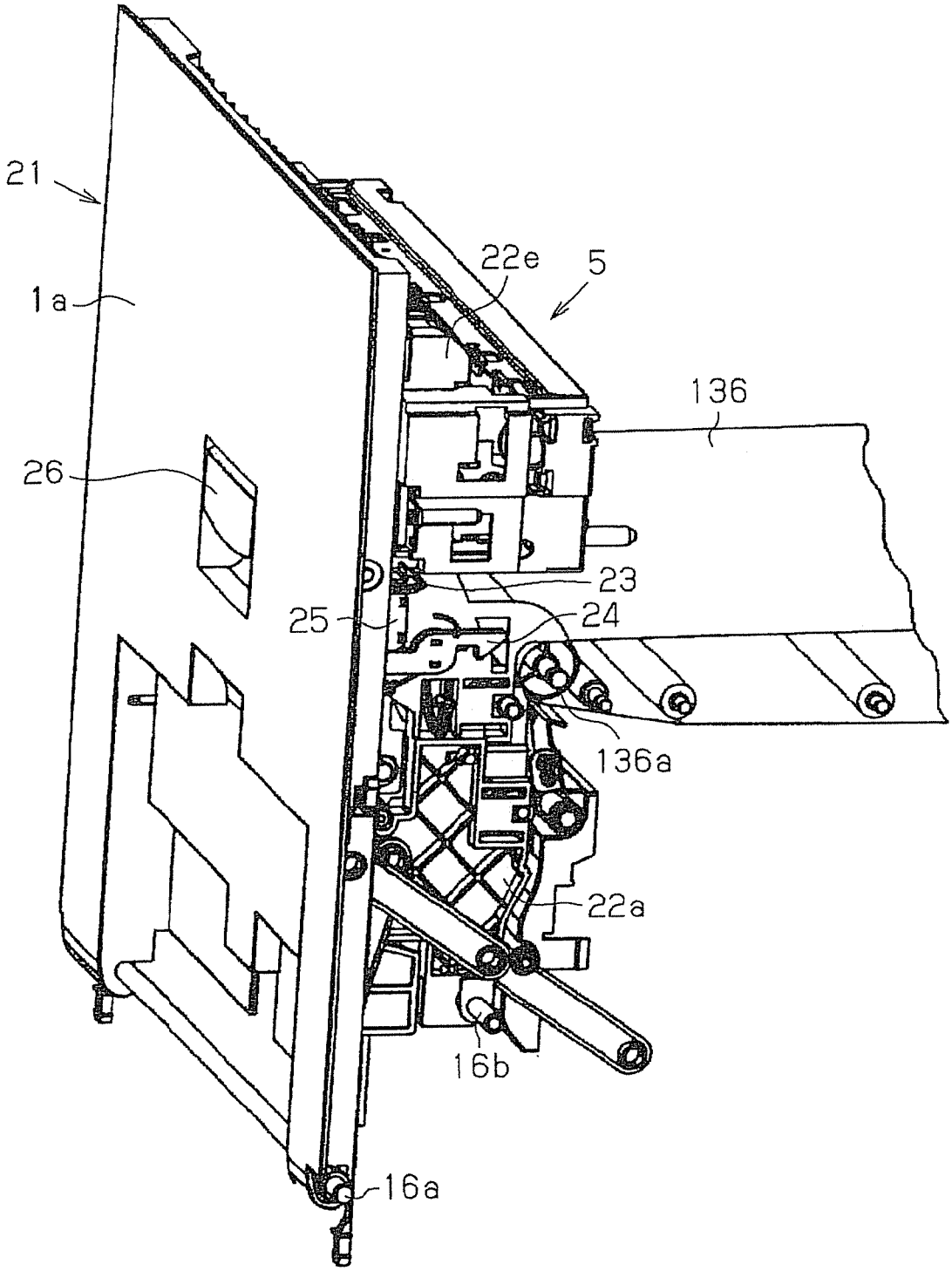
FIG. 2 is a perspective view diagram of a relevant portion of the image forming device according to an embodiment of the present invention illustrating a situation in which the opening/closing cover and the paper transport guide member are locked.
Figure 3:
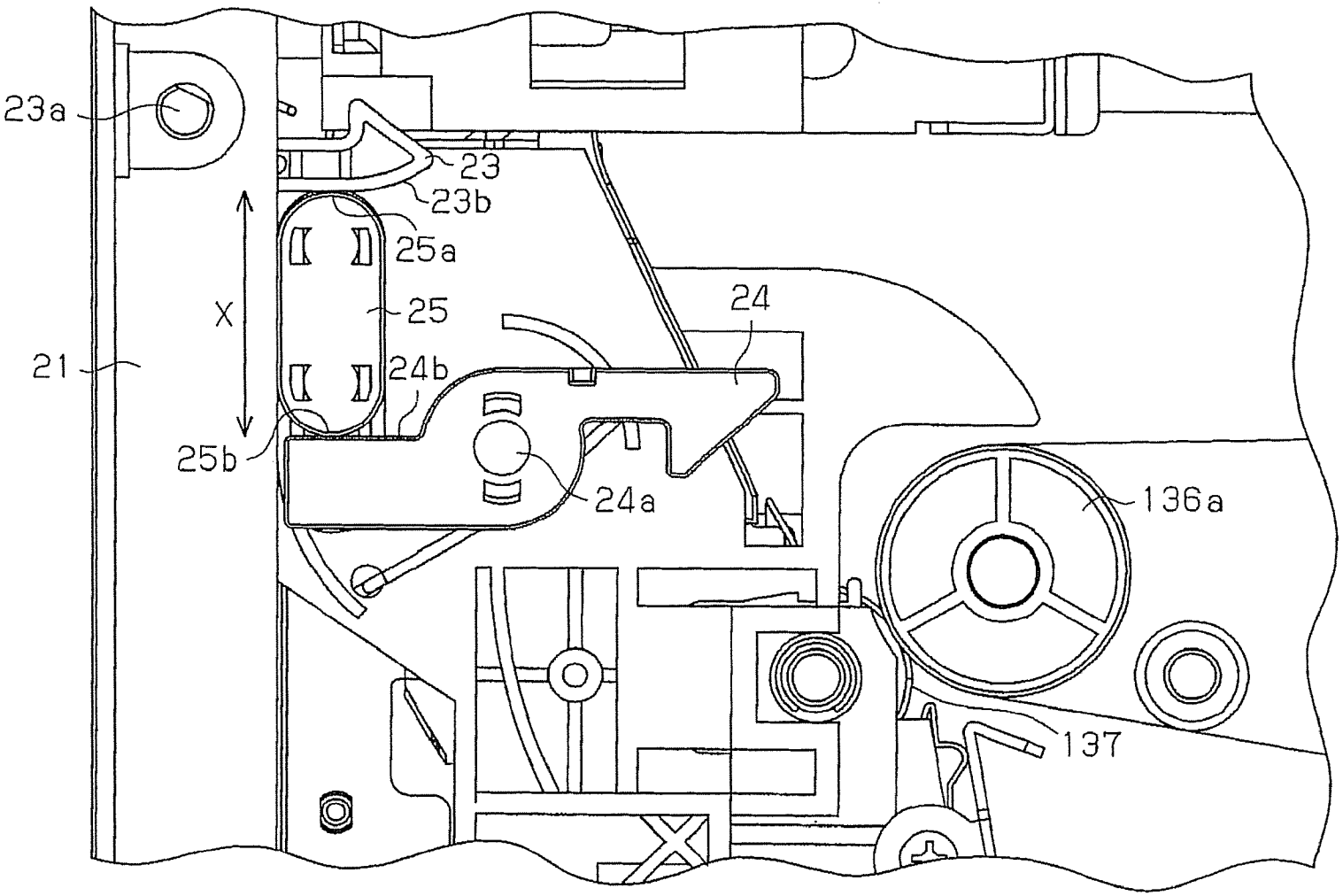
FIG. 3 is a partial enlarged view of FIG. 2.
Figure 4:
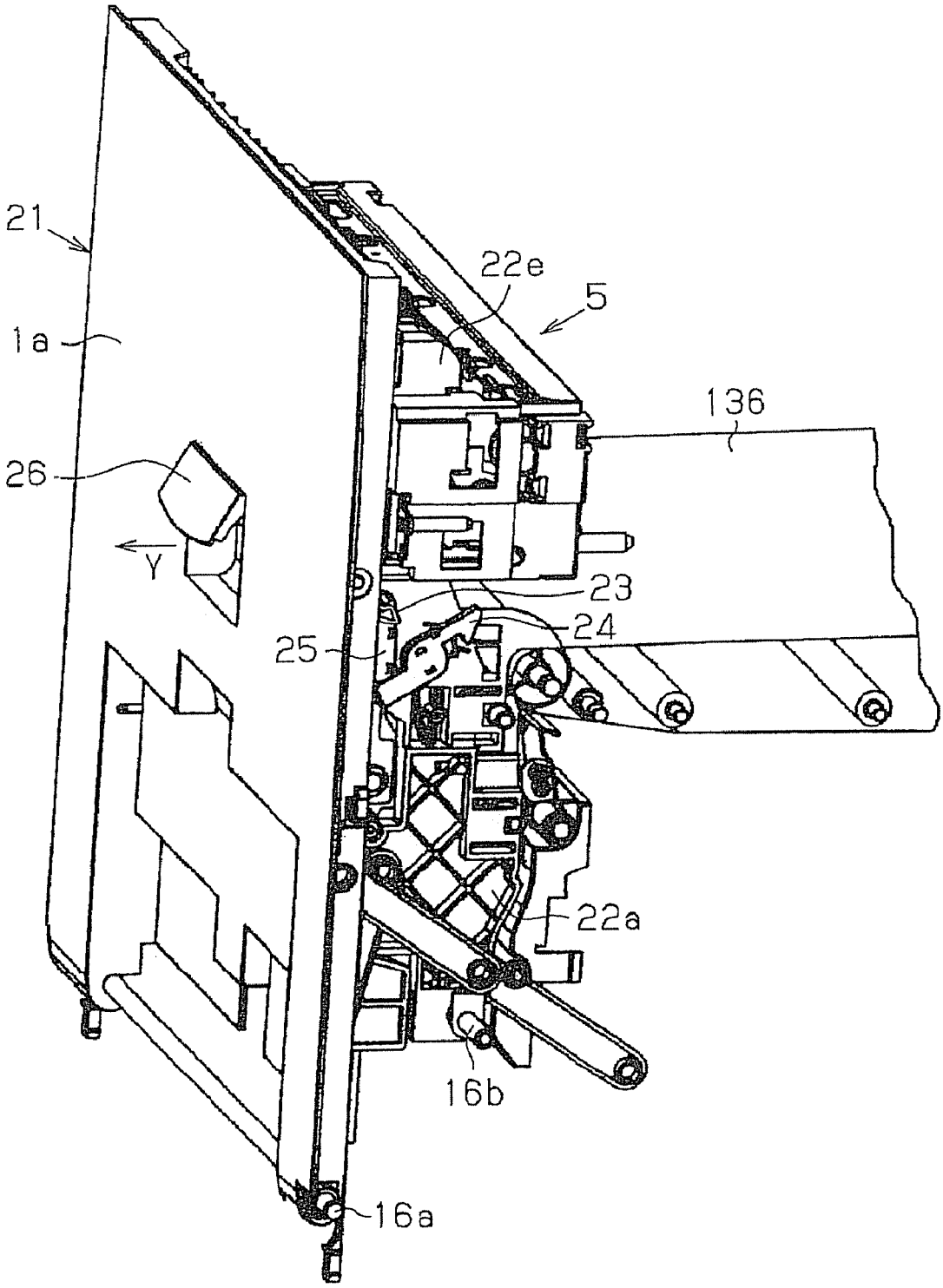
FIG. 4 is a perspective view diagram of a relevant portion of the image forming device according to an embodiment of the present invention illustrating a situation in which the opening/closing cover and the paper transport guide member are unlocked.
Figure 5:
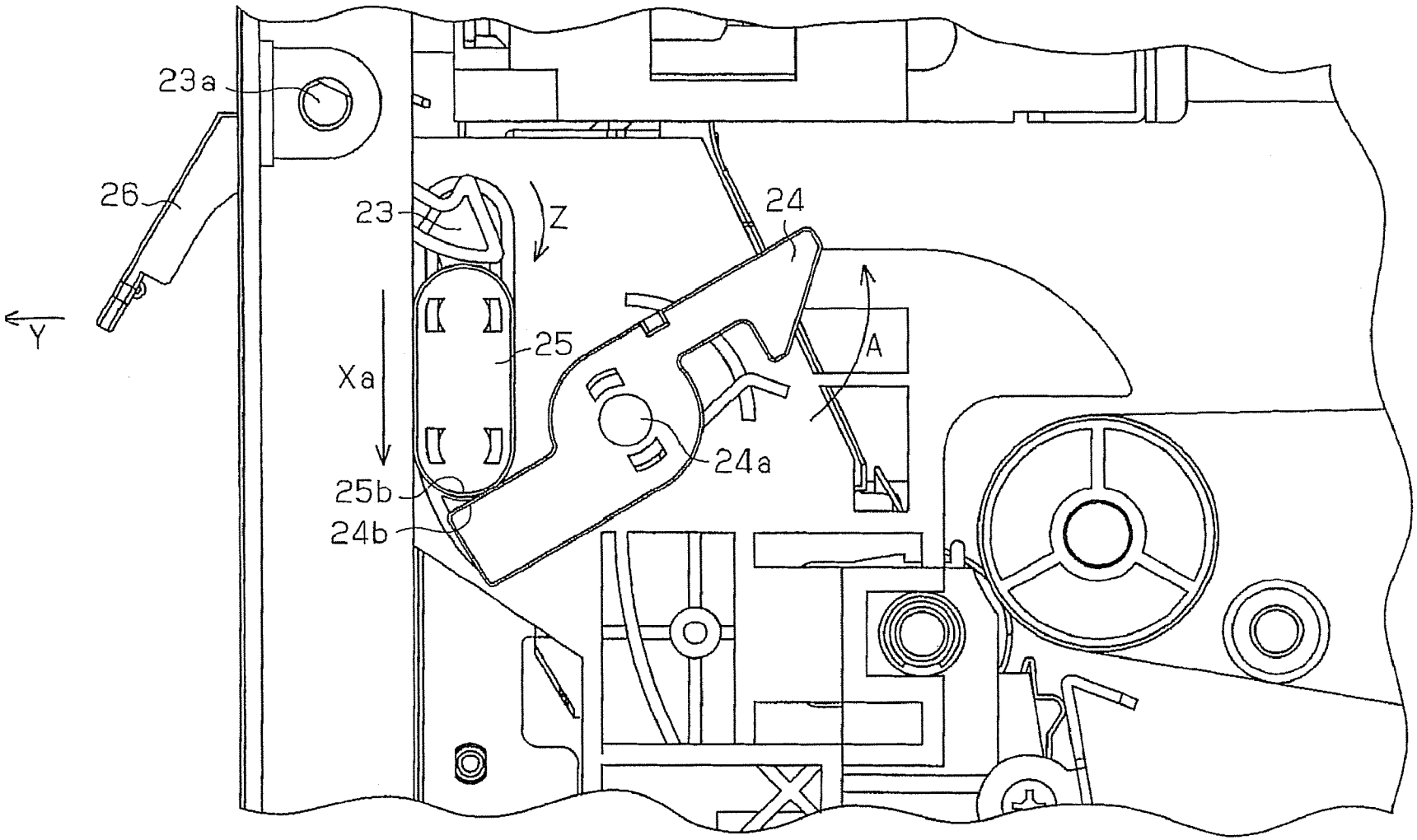
FIG. 5 is a partial enlarged view of FIG. 4.

The opening and closing mechanism of the paper transport unit 9 and the reverse transport unit 14 for handling a paper jam is described next. FIG. 2 is a perspective view diagram of a relevant portion of the image forming device according to the present embodiment illustrating a situation in which the opening/closing cover and the paper transport guide member are locked; FIG. 3 is a partial enlarged view of FIG. 2. FIG. 4 is a perspective view diagram of a relevant portion of the image forming device according to the present embodiment illustrating a situation in which the opening/closing cover and the paper transport guide member are unlocked; FIG. 5 is a partial enlarged view of FIG. 4.

As illustrated in FIG. 2 and FIG. 3, the opening/closing cover 21 is provided with a locking lever 23, as a first locking member, such that, during image formation, the locking lever 23 is latched by a latch member (not shown in the figures) provided in the side of the device main body 2 so as to lock in a closed state (FIGS. 1 through 3) the opening/closing cover 21 to the device main body 2. The locking lever 23 is pivotally supported by a pivoting shaft 23*a*. In the paper transport guide member 22*a* is provided a locking lever 24, as a second locking member, such that, during image formation, the locking lever 24 is latched by another latch member (not shown in the figures) provided in the side of the device main body 2, so as to lock the paper transport guide member 22*a* to the device main body 2 with a predetermined vertical posture (FIGS. 1 through 3). The locking lever 24 is pivotally supported by a pivoting shaft 24*a*.

In the paper transport guide member 22*a* is also provided a shifting member 25 for swiveling the locking lever 24. This shifting member 25 is disposed between the locking levers 23 and 24, the locking levers 23 and 24 being disposed at positions abutting the shifting member 25. More specifically, as illustrated in FIG. 3, the shifting member 25 is disposed at a position such that an upper end 25*a* of the shifting member 25 abuts a lower end 23*b* of the locking lever 23 and a lower end 25*b* of the shifting member 25 abuts a rear upper end 24*b* of the locking lever 24. The shifting member 25, also, is movable in a substantially vertical direction (the direction of the arrow X in the figure) through the action of a sliding mechanism not shown in the figure, in such a way that the locking lever 24 can swivel a predetermined angle in response to the displacement of the shifting member 25.

On a side face 1*a* of the opening/closing cover 21 (or the device main body 2) is provided an unlocking member 26 for releasing the lock of the opening/closing cover 21 and of the paper transport guide member 22*a* during handling of a paper jam. The unlocking member 26 is formed with the above locking lever 23 as a single unit, in such a way that the locking lever 23 can swivel in response to the operation of the unlocking member 26. In the present embodiment, thus, the locking levers 23, 24, the shifting member 25 and the unlocking member 26 constitute a locking mechanism for locking the opening/closing cover 21 and the paper transport guide member 22*a* to the device main body 2.

An operation for removing jammed paper is described next. A first operation herein involves releasing the locking mechanism. More specifically, the unlocking member 26 is moved from the situation shown in FIG. 2 towards the front (i.e. in the direction indicated by the arrow Y in FIG. 4). Thereupon, the locking lever 23 swivels in the unlocking direction shown in FIG. 5 (i.e. the direction of the arrow Z) in response to the operation of the unlocking member 26, since, as described above, the unlocking member 26 is formed with the above locking lever 23 as a single unit; as a result, the locking lever 23 becomes unlatched from the above-described latch member. The opening/closing cover 21 is thereby unlocked from the device main body 2.

The locking lever 23 swivels also in the locking direction, with the lower end 23*b* thereof abutting the upper end 25*a* of the shifting member 25 since, as explained above, the upper end 25*a* of the shifting member 25 abuts the lower end 23*b* of the locking lever 23. The upper end 25*a* of the shifting member 25 is thus pushed by the locking lever 23, whereby the shifting member 25 is displaced downwards (i.e. in the direction indicated by the arrow Xa in FIG. 5) while abutting the locking lever 23.

Then, since the rear upper end 24*b* of the locking lever 24 abuts the lower end of the shifting member 25, as described above, the shifting member 25 moves downwards abutting all the time the rear upper end 24*b*. Thereupon, the lower end 25*b* of the shifting member 25 pushes the rear upper end 24*b* of the locking lever 24, whereby the locking lever 24, in response to the shift operation of the shifting member 25, swivels in the unlocking direction shown in FIG. 5 (i.e. the direction of arrow A), thereby unlatching the locking lever 24 from the above-described other latch member. That is, both the locking lever 23 and the locking lever 24 swivel in the unlocking direction in response to the operation of the unlocking member 26 thereby unlatching the locking lever 24 from the other latch member. Both the lock of the opening/closing cover 21 and the lock of the paper transport guide member 22*a* to the device main body 2 are thus simultaneously released.

Figure 6:
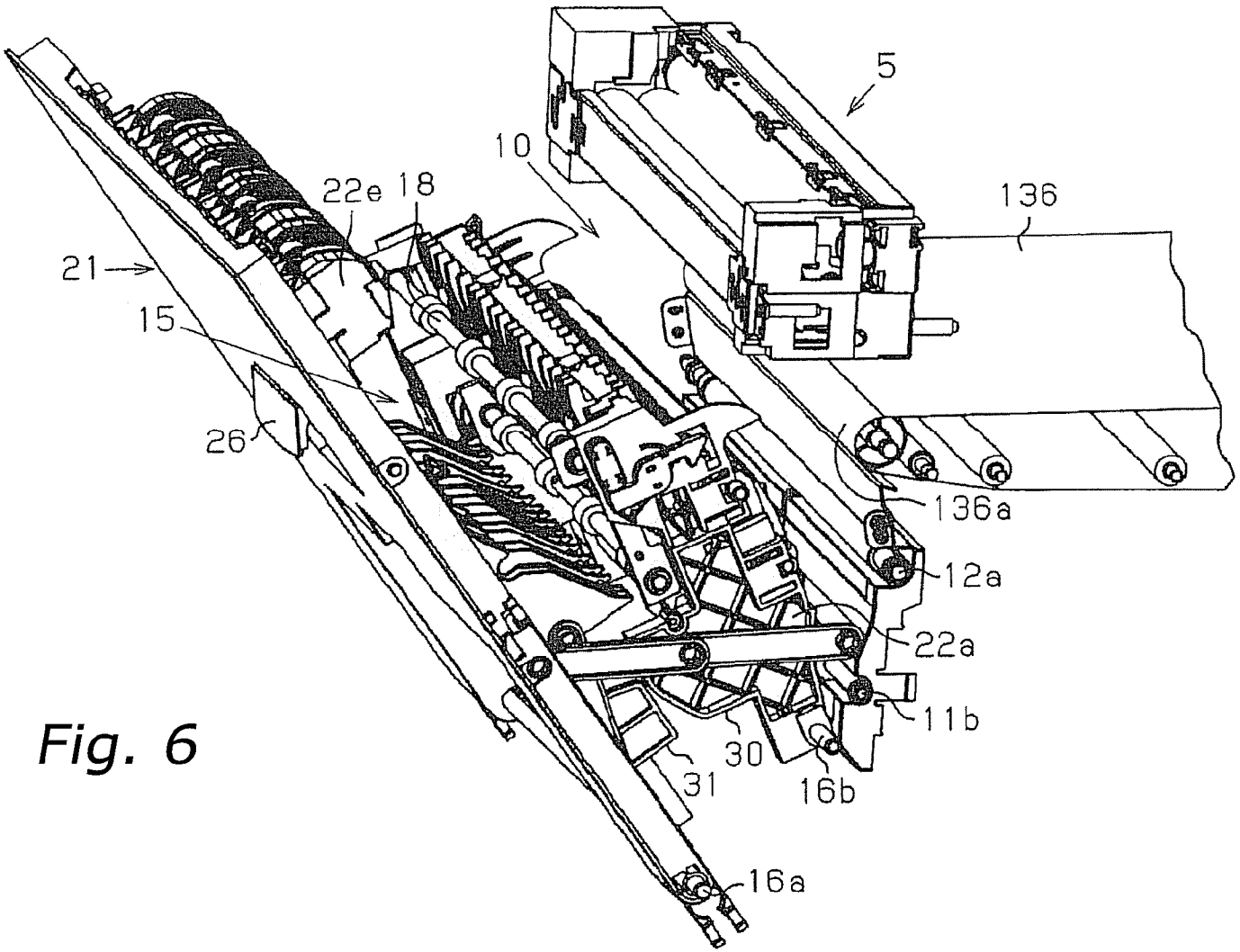
FIG. 6 is an external perspective view diagram of an image forming device according to an embodiment of the present invention illustrating a situation where an opening/closing cover and a paper transport guide member are open.

The opening operation of the paper transport path 10 and the reverse transport path 15 upon handling a paper jam is described next. FIG. 6 is an external perspective view diagram of the image forming device according to the present embodiment illustrating a situation where the opening/closing cover and the paper transport guide member are open, while FIG. 7 is an external perspective view diagram illustrating a situation where the opening/closing cover and the paper transport guide member are further opened from the situation in FIG. 6.

For opening the paper transport path 10 and the reverse transport path 15, with the opening/closing cover 21 and the paper transport guide member 22*a* in an unlocked state, first the opening/closing cover 21 is turned a predetermined angle around the pivoting shaft 16*a* to open the opening/closing cover 21, as shown in FIG. 4. A supporting rib 31 as a support member, for supporting the paper transport guide member 22*a* and provided protruding into the lower side of the opening/closing cover 21, engages with a protrusion 30 provided on the lower portion of the paper transport guide member 22*a*; as a result, the paper transport guide member 22*a* swivels around the pivoting shaft 16*b* to open the paper transport guide member 22*a* to a predetermined angle (FIG. 6). In the present embodiment, thus, the pivotally supported paper transport guide member 22*a* is opened in response to the opening movement of the opening/closing cover 21.

In the present embodiment, as shown in FIG. 6, the protrusion 30 of the paper transport guide member 22*a* keeps abutting the supporting rib 31, so that the paper transport guide member 22*a* is supported by the opening/closing cover 21 via the protrusion 30 and the supporting rib 31. When, from the situation illustrated in FIG. 6, the opening/closing cover 21 is then further opened, the protrusion 30 slides while abutting the supporting rib 31, and the paper transport guide member 22*a*, supported by the opening/closing cover 21, swivels further around the pivoting shaft 16*b*; as a result, the paper transport path 10 and the reverse transport path 15 are opened simultaneously (FIG. 7). The jammed paper can then be removed in that situation. In the present embodiment, thus, removing jammed paper requires fewer manipulations, which improves operability, as the paper transport path 10 and the reverse transport path 15 are simultaneously opened by the swiveling of the paper transport guide member 22*a* in response to the opening movement of the opening/closing cover 21.

Figure 7:
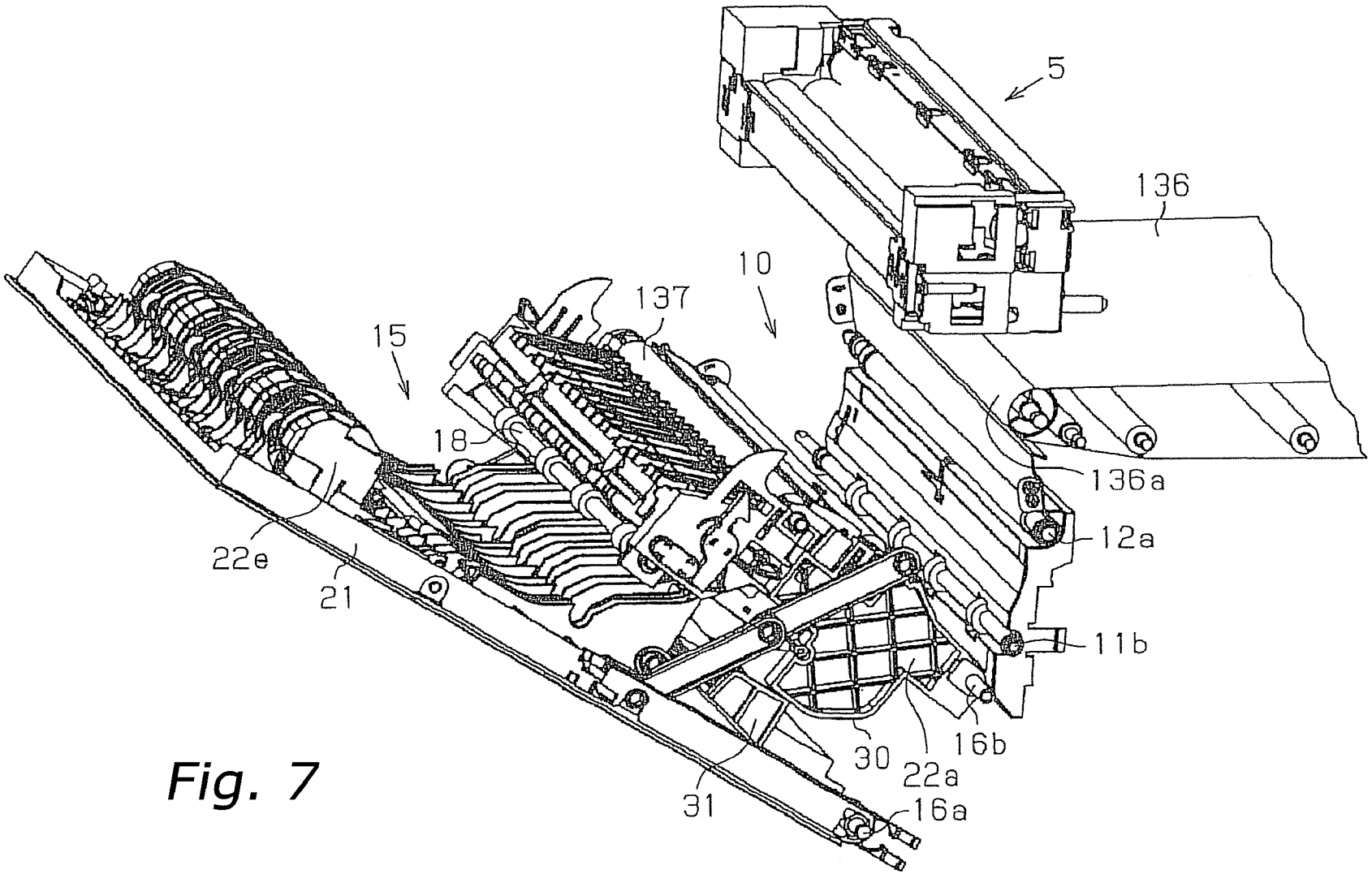
FIG. 7 is an external perspective view diagram illustrating a situation where the opening/closing cover and the paper transport guide member are further opened from the situation in FIG. 6.

Also, as illustrated in FIG. 7, the paper transport guide member 22*a* can be further opened while supported on the opening/closing cover 21, which affords a larger opening angle between the paper transport path 10 and the reverse transport path 15, allowing thereby the jammed paper to be removed easily.

When after removal of the jammed paper the opening/closing cover 21 is swiveled from the open situation shown in FIG. 7 to the closed situation shown in FIG. 2, the supporting rib 31 slides while abutting the protrusion 30 and the paper transport guide member 22*a*, supported by the opening/closing cover 21, swivels around the pivoting shaft 16*b*. The paper transport guide member 22*a* swivels thereupon pushed up by the opening/closing member 21, to eventually reach the situation illustrated in FIG. 2. That is, a situation is reached again in which both the opening/closing cover 21 and the paper transport guide member 22*a* are closed and locked to the device main body 2. In the present embodiment, thus, the paper transport guide member 22*a* becomes closed in response to the closing movement of the opening/closing cover 21.

In the present embodiment, as explained above, the paper transport path 10 and the reverse transport path 15 are simultaneously opened by the swiveling of the paper transport guide member 22*a* in response to the opening movement of the opening/closing cover 21; upon handling a paper jam, therefore, the paper transport path 10 and the reverse transport path 15 can thus be simultaneously opened by opening the opening/closing cover 21 alone. It is thus not necessary to separately operate a reverse transport unit and an opening/closing cover (or an internal frame member), as was the case in the above-described conventional art, which improves operability during removal of jammed paper.

Also, the opening/closing cover 21 and the paper transport guide member 22*a* are supported by different pivoting shafts. Thus, the opening angle between the paper transport path 10 and the reverse transport path 15 can be made larger than when the opening/closing cover 21 and the paper transport guide member 22*a* are supported by a same rotating shaft, which allows jammed paper to be easily removed.

Also, the opening/closing cover 21 is provided with a supporting rib 31 for supporting the paper transport guide member 22*a* during swiveling of the latter. The reverse transport path 15, therefore, does not become closed on account of the weight of the paper transport guide member 22*a* itself upon simultaneous opening of paper transport path 10 and of the reverse transport path 15; as a result, the reverse transport path 15 can remain open, which allows the jammed paper to be removed easily.

The paper transport guide member 22*a* is also provided with a protrusion 30 for sliding while abutting the supporting rib 31 upon swiveling of the paper transport guide member 22*a*. The paper transport guide member 22*a* can therefore swivel further out around the pivoting shaft 16*b* while supported on the opening/closing cover 21, which enables a smooth swiveling of the paper transport guide member 22*a*.

In the present embodiment, also, the opening/closing cover 21 and the paper transport guide member 22*a* can be simultaneously unlocked by a shift in a predetermined unlocking direction of the locking levers 23, 24, in response to the operation of an unlocking member 26. It thus becomes possible to simultaneously open both locking levers 23, 24, by operating only the unlocking member 26, which facilitates unlocking when handling a paper jam.

In the present embodiment, furthermore, the locking lever 23 and the locking lever 24 are pivotably supported and have a movable shifting member 25 provided therebetween. In response to an operation of the unlocking member 26, the locking lever 23 swivels in the unlocking direction, thereby unlocking the opening/closing cover 21, the shifting member 25 is pushed by the locking lever 23 and shifts, and the locking lever 24 swivels in the unlocking direction in response to the shift of the shifting member 25, thereby unlocking the paper transport guide member 22*a*. The locking levers 23, 24 can therefore be simultaneously opened with a simple constitution.

The above embodiments are merely given as illustrative examples and are not meant in any way to limit the scope of the present invention; within the purport of the present invention, various modifications may be made to the dimensions, materials, shapes, relative arrangements, etc. of the recited constituent elements without departing from the scope of the invention.

In the above embodiment, for example, the paper transport guide member 22*a* opens to a predetermined angle by swiveling around the pivoting shaft 16*b* through the engaging of the protrusion 30 and the supporting rib 31; however, the paper transport guide member 22*a* may also be obliquely supported by the opening/closing cover 21 when the latter is closed, in such a way that the paper transport guide member 22*a* swivels by its own weight in response to the opening movement of the opening/closing cover 21.

In the above embodiment, also, the paper transport guide member 22*a* is provided with a shifting member 25 for swiveling the locking lever 24; however, the locking levers 23, 24 may also be formed herein as a single unit moving in a predetermined unlocking direction in response to the operation of the unlocking member 26.

The above embodiment has been explained using a tandem-type color image forming device in which a plurality of image forming units are disposed along the paper transport direction; however, the present invention can also be suitably used in image forming devices provided with only one image forming unit.

Although a copying machine has been illustrated as an example of the image forming device in the above embodiment, it is obvious that some other image forming device such as fax device, a printer or the like may also have been used to that end.

What is claimed is:

1. An image forming device comprising:

a device main body;

an image forming unit for forming images on paper;

a paper feeding unit disposed upstream from the image forming unit, for transporting the paper to the image forming unit;

an output unit disposed downstream from the image forming unit, for storing output paper upon which images have been formed by the image forming unit;

a paper transport path disposed between the paper feeding unit and the output unit;

a reverse paper transport path extending along a side face of the device main body, for reversing the paper having an image formed on one face thereof, and for transporting the paper to the image forming unit;

an opening/closing member pivotally supported relative to the device main body; and a pivotably supported paper transport guide member constituting the paper transport path and the reverse paper transport path and moving in response to an opening/closing movement of the opening/closing member, the paper transport guide member swiveling in response to the opening movement of the opening/closing member and thereby opening simultaneously the paper transport path and the reverse paper transport path, the opening/closing member and the paper transport guide member being supported on different pivoting shafts.

2. An image forming device according to claim 1, wherein the opening/closing member is provided with a support member for supporting the paper transport guide member during swiveling of the paper transport guide member.

3. An image forming device according to claim 2, wherein the paper transport guide member is provided with a protrusion that slides while abutting the support member during swiveling of the paper transport guide member.

4. An image forming device according to claim 1, further comprising, a first locking member for locking the opening/closing member to the device main body, and a second locking member for locking the paper transport guide member to the device main body; and an unlocking member for unlocking the opening/closing member and the paper transport guide member, wherein the first and second locking members move in an unlocking direction in response to an operation of the unlocking member thereby simultaneously unlocking the opening/closing member and the paper transport guide member.

5. An image forming device according to claim 4, further comprising a shifting member wherein the first and second locking members are pivotally supported, the shifting member movably provided between the first locking member and the second locking member such that, in response to an operation of the unlocking member, the first locking member swivels in the unlocking direction thereby unlocking the opening/closing member, the shifting member shifts pushed by the first locking member, and the second locking member swivels in the unlocking direction in response to the shift of the shifting member, thereby unlocking the paper transport guide member.

6. An image forming device according to claim 1, wherein the image forming device is a tandem-type color image forming device.

7. An image forming device, comprising:

a device main body;

an image forming unit forming images on paper;

a paper feeding unit being disposed upstream from the image forming unit to transport the paper to the image forming unit;

an output unit being disposed downstream from the image forming unit to store output paper upon which images have been formed by the image forming unit;

a paper transport path being disposed between the paper feeding unit and the output unit;

a reverse paper transport path extending along a side face of the device main body to reverse the paper having an image formed on one face thereof, and to transport the paper to the image forming unit;

an opening/closing member pivotally supported relative to the device main body, and having a support member; and a pivotably supported paper transport guide member constituting the paper transport path and the reverse paper transport path and moving in response to an opening/closing movement of the opening/closing member, the paper transport guide member swiveling in response to the opening movement of the opening/closing member and thereby opening simultaneously the paper transport path and the reverse paper transport path, the support member being non-movably fixed to the opening/closing member and being provided to support the paper transport guide member during swiveling of the paper transport guide member, the support member protruding between the opening/closing member and the paper transport guide member from the opening/closing member toward the paper transport guide member.

8. An image forming device according to claim 7, wherein the paper transport guide member is provided with a protrusion that slides while abutting the support member during swiveling of the paper transport guide member.

9. An image forming device comprising:

a device main body;

an image forming unit forming images on paper;

a paper feeding unit being disposed upstream from the image forming unit to transport the paper to the image forming unit;

an output unit being disposed downstream from the image forming unit to store output paper upon which images have been formed by the image forming unit;

a paper transport path being disposed between the paper feeding unit and the output unit;

a reverse paper transport path extending along a side face of the device main body to reverse the paper having an image formed on one face thereof, and to transport the paper to the image forming unit;

an opening/closing member pivotally supported relative to the device main body; and a pivotably supported paper transport guide member having a non-rotatable integral protrusion being unitarily formed with the paper transport guide member, the paper transport guide member constituting the paper transport path and the reverse paper transport path and moving in response to an opening/closing movement of the opening/closing member, the paper transport guide member swiveling in response to the opening movement of the opening/closing member and thereby opening simultaneously the paper transport path and the reverse paper transport path, the opening/closing member being provided with a support member to support the paper transport guide member during swiveling of the paper transport guide member, the protrusion of the paper transport guide member sliding while abutting the support member during swiveling of the paper transport guide member.

* * * * *